US009004177B2

(12) United States Patent
Hatton

(10) Patent No.: US 9,004,177 B2
(45) Date of Patent: Apr. 14, 2015

(54) SUBSEA PRODUCTION SYSTEMS AND METHODS

(75) Inventor: Gregory John Hatton, Houston, TX (US)

(73) Assignee: Shell Oil Company, Houston, TX (US)

( * ) Notice: Subject to any disclaimer, the term of this patent is extended or adjusted under 35 U.S.C. 154(b) by 900 days.

(21) Appl. No.: 13/144,709

(22) PCT Filed: Jan. 8, 2010

(86) PCT No.: PCT/US2010/020421

§ 371 (c)(1), (2), (4) Date: Aug. 11, 2011

(87) PCT Pub. No.: WO2010/083095

PCT Pub. Date: Jul. 22, 2010

(65) Prior Publication Data

US 2011/0290498 A1 Dec. 1, 2011

Related U.S. Application Data

(60) Provisional application No. 61/145,170, filed on Jan. 16, 2009.

(51) Int. Cl.
*E21B 43/017* (2006.01)
*E21B 43/36* (2006.01)

(52) U.S. Cl.
CPC ..... *E21B 43/017* (2013.01); *E21B 43/36* (2013.01)

(58) Field of Classification Search
CPC ..... E21B 43/017; E21B 43/36
USPC ..... 166/345, 357, 366, 267, 302, 75.12; 165/916
See application file for complete search history.

(56) References Cited

U.S. PATENT DOCUMENTS

| | | | | |
|---|---|---|---|---|
| 5,803,161 | A * | 9/1998 | Wahle et al. | 165/104.21 |
| 6,070,417 | A * | 6/2000 | Benson | 62/71 |
| 6,230,810 | B1 * | 5/2001 | Rivas | 166/357 |
| 6,656,366 | B1 * | 12/2003 | O'Sullivan et al. | 210/737 |
| 6,672,391 | B2 * | 1/2004 | Anderson et al. | 166/357 |
| 7,426,963 | B2 * | 9/2008 | O'Neill | 166/365 |
| 7,516,794 | B2 * | 4/2009 | Gramme et al. | 166/357 |
| 2006/0175062 | A1 * | 8/2006 | Benson | 166/335 |
| 2006/0175063 | A1 * | 8/2006 | Balkanyi et al. | 166/357 |
| 2009/0078406 | A1 * | 3/2009 | Talley et al. | 166/177.3 |
| 2010/0012325 | A1 * | 1/2010 | Friedemann | 166/335 |

* cited by examiner

*Primary Examiner* — Matthew Buck

(57) ABSTRACT

A subsea production system, comprising a plurality of wells located on a sea floor, the wells producing a fluid comprising hydrocarbons; a cold flow center on the sea floor, the cold flow center fluidly connected to the plurality of wells; and a production facility on land or on a floating structure, the production facility fluidly connected to the cold flow center; wherein the cold flow center lowers a temperature of the fluid and produces a slurry of the fluid and suspended solids for transportation to the production facility.

19 Claims, 2 Drawing Sheets

SUBSEA PRODUCTION SYSTEMS AND METHODS

PRIORITY CLAIM

The present application claims priority from PCT/US2010/020421, filed 8 Jan. 2010, which claims priority from U.S. provisional application No. 61/145,170, filed 16 Jan. 2009.

FIELD OF THE INVENTION

The present disclosure relates to cold flow center and centers.

BACKGROUND OF THE INVENTION

Currently, subsea fields located where sea bottom temperatures and flowline pressure are in the wax region and/or in the hydrate region are developed with a heat retention (HR), or heat retention and heat addition (HRAHA) strategy for the flowline back to topsides. These HR and HRAHA systems may have one well or multiple wells. The multiple wells, HR and HRAHA systems may have numerous configurations: (i) multiple wells feeding one manifold that is connected by a flowline system back topsides, (ii) multiple multiple-wells manifolds feeding a flowline system back topsides, (iii) multiple wells feeding a flowline system back topsides, and (iv) one or more wells, and one or more manifolds feeding a flowline system back topsides.

Recently, it has been proposed that these fields could be developed with a cold flow strategy. In contrast to the currently used strategies, a cold flow strategy allows or promotes precipitation and produces a transportable slurry stream, which moves to a distant topsides flowline that does not have to retain or add heat.

Two well-stream-collection strategies have been proposed for cold flow systems:

In the SINTEF system, the cold flow system is started with one well stream and a re-cycle system. Then, additional single unprocessed well-flow-streams are added to the processed stream (one by one).

In the other systems, a stream from one or more nearby wells is used as the single input to the cold flow processing system, and then the processed stream is sent to the topsides facility.

U.S. Patent Application Publication Number 2006/0175063 discloses a system for assuring subsea hydrocarbon production flow in pipelines by chilling the hydrocarbon production flow in a heat exchanger and causing solids to form, periodically removing deposits and placing them in a slurry utilizing a closed loop pig launching and receiving systems. U.S. Patent Application Publication Number 2006/0175063 is herein incorporated by reference in its entirety.

There is a need in the art for improved cold flow systems which can operate without adding heat.

SUMMARY OF THE INVENTION

The present disclosure provides a more efficient, less costly way to develop subsea hydrocarbon reserves. The disclosure provides the means and methods for combining cold flow devices and non-cold-flow production technology to reduce the number of required cold flow devices.

One aspect of the invention provides a subsea production system, comprising a plurality of wells located on a sea floor, the wells producing a fluid comprising hydrocarbons; a cold flow center on the sea floor, the cold flow center fluidly connected to the plurality of wells; and a production facility on land or on a floating structure, the production facility fluidly connected to the cold flow center; wherein the cold flow center lowers a temperature of the fluid and produces a slurry of the fluid and suspended solids for transportation to the production facility.

Another aspect of the invention provides a method of producing hydrocarbons from a subsea field, comprising drilling a plurality of wells into the field on a seafloor; fluidly connecting the wells to a cold flow center; fluidly connecting the cold flow center to a production facility on land or on a floating offshore structure; producing a fluid comprising hydrocarbons from the wells to the cold flow center; lowering a temperature of the fluid at the cold flow center to precipitate out one or more solids into the fluid; forming a slurry of the fluid and the solids; and transporting the slurry from the cold flow center to the production facility.

DETAILED DESCRIPTION OF THE INVENTION

In one aspect, embodiments disclosed herein relate generally to apparatuses and methods for transporting hydrocarbons. Specifically, embodiments disclosed herein relate to a system for transporting a production stream from a wellbore to a production system (e.g., an off-shore surface facility, a land facility). As used herein, 'production stream' refers to a stream of hydrocarbons containing water, various types of waxes, crystals, and/or other components that are extracted from a wellbore during production.

Production streams are extracted from wellbores that are located in various environments having varying temperatures and pressures. These environments include a sub-sea environment, where wellbore wellheads are located at the bottom of the sea hundreds to thousands of feet below the surface of the ocean. In the sub-sea environment, the temperature of the ocean water that surrounds the system for transporting a production stream from a wellbore to a production system may be lower than the temperature inside the wellbore.

During operation, the production stream flows out of the wellbore and into a transfer line of the system for transporting a production stream. The transfer line is usually exposed to the ocean water, which may cause the temperature of the production stream to decrease. As a result, hydrates and/or wax may form within the production stream. Further, while hydrates form, water may become trapped within a layer of hydrates. Furthermore, the water, wax and/or hydrates with occluded water may become adhered to the inner wall of the transfer line. The accumulation of water, hydrates and wax with occluded water on the inner wall of the transfer line may cause a blockage in the transfer line, which may stop production and/or decrease efficiency of the operation.

In certain instances, hydrate and wax particles flowing through tubing or lines are not necessarily a problem per se. If the particles do not deposit on walls or equipment, and do not have a large impact on flow characteristics, they may simply flow with the rest of the production stream, without creating a problem situation. Thus, it is desired to achieve a situation where hydrates and wax are formed in a controlled manner, thereby allowing the hydrates and wax to flow through lines and pipes without blocking the flow. In addition, it is desired to reduce hydrate accumulation throughout the transportation system. Accordingly, a system that can control the formation of hydrates and wax and prevent blockage formation while transporting a production stream from a wellbore to a production system is desired.

Figure 1:
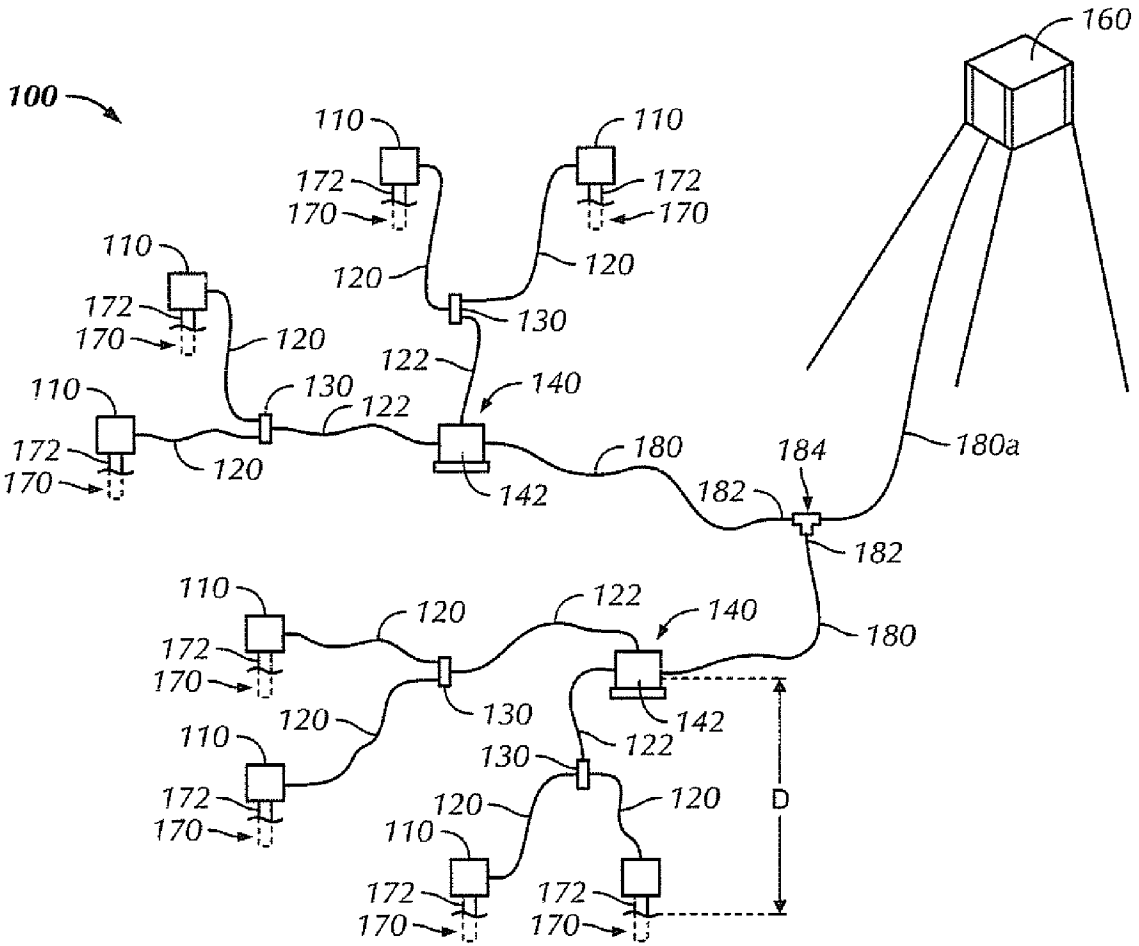
FIG. 1 shows a transportation system in accordance with embodiments of the present disclosure.

General Overview:

Referring to FIG. 1, a transportation system 100 in accordance with embodiments of the present disclosure is shown. The transportation system 100 is configured to efficiently transport a production stream from a wellbore to a production system 160 located on the surface of the ocean. In an alternate embodiment, the transportation system 100 may include a production system 160 that is located on land.

During production of a field of wellbores 170, the production stream from each wellbore is extracted and transported through a pipe 172 to flow control system 110. The production streams from multiple flow control systems 110 are then transferred through transfer lines 120 to manifolds 130, directly to flow line 122, or directly to cold flow center 140. Each manifold 130 directs the production stream into at least one flow line 122 that transports the production stream from the manifolds 130 to a cold flow center 140. A cold flow device 142 of the cold flow center 140 receives the flow of production streams from multiple wells 170 through a plurality of openings. Next, the production stream flows through the cold flow device 142, which transforms the production stream into transportable slurry as the temperature of the production stream approaches the temperature of the surrounding ocean water.

Figure 2:
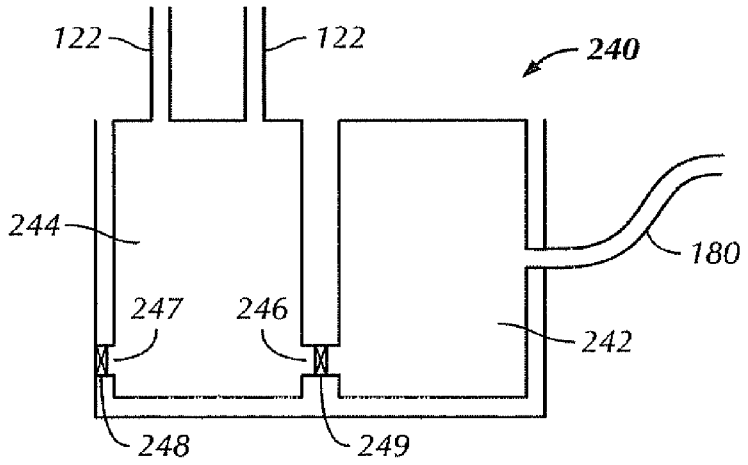
FIG. 2 shows a component view of a cold flow center in accordance with embodiments of the present disclosure.

Referring to FIG. 2, in select embodiments, a cold flow center 240 in accordance with embodiments of the present disclosure is used to receive the production stream. The production stream may contain fluids and/or small particles that may need to be separated. As such, the cold flow center 240 may include a separator 244 that is configured to separate fluids (e.g., water and/or gas) and small particles (e.g., sand) from the production stream before it is transferred into a cold flow device 242. The production stream is transferred into the cold flow device 242 through a first aperture 246. The cold flow device 242 is configured similar to the cold flow device 142, shown in FIG. 1. Thus, it may be used to transform the production stream into a transportable slurry. Furthermore, the fluid and/or small particles that have been separated from the production stream are transferred through a second aperture 247 for disposal (e.g., into the ocean).

Figure 3:
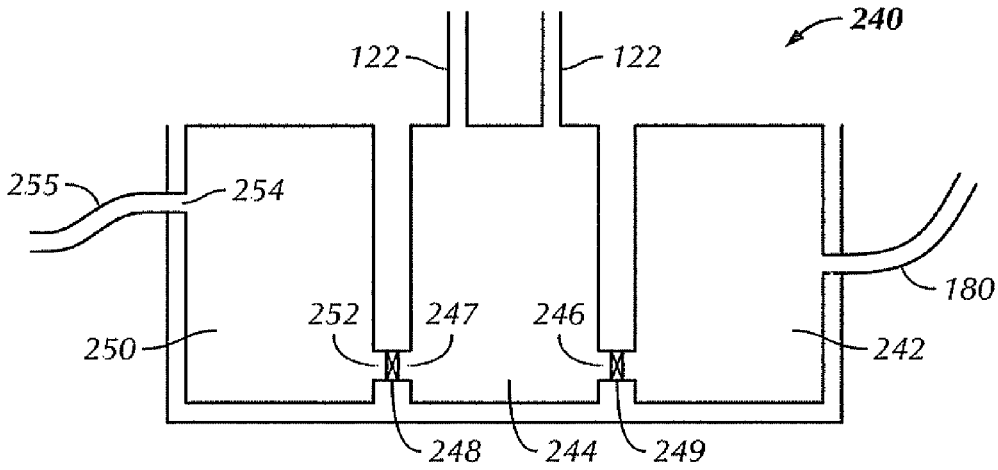
FIG. 3 shows a component view of a cold flow center in accordance with embodiments of the present disclosure.

Referring to FIG. 3, in select embodiments, the fluids and/or small particles that are separated from separator 244 may be injected into one or more wellbores. Thus, the fluids and/or small particles are transferred out of the separator 244 through the second aperture 247 and into pump 250 through inlet 252. As the fluids and/or small particles are transferred into the pump 250, the pump 250 may pump the fluids and/or small particles through an outlet 254 and into fluid line 255. The fluid line 255 may then transfer the fluids and/or small particles to a wellbore, where they may be injected into a reservoir.

Systems combining discharge to the sea (e.g., sand and water) (FIG. 2) and to a disposal well (e.g., water possibly with hydrocarbon contamination) (FIG. 3) may also be included.

Referring back to FIG. 1, once the production stream has been converted into transportable slurry at a temperature close to the surrounding ocean water temperature, the transportable slurry flows, with or without a pump, out of the cold flow device 142 and into the tubular line 180. Finally, the tubular line 180*a* carries the production stream to the production system 160, where it may be stored or further processed.

System Components

As show in FIG. 1, the flow control systems 110 are positioned near the wellbores 170, so that they may receive the production stream flowing from the wellbores 170. As previously stated, the production stream may be transferred from the wellbores 170 to the flow control system 110 through pipe 172. Further, the flow control systems 110 may be used to control the flow rate of the production stream as it exits the wellbore. For example, the flow control systems 110 may include a flow control device, such as, a choke valve, a butterfly valve, or any other flow control device known in the art. The production stream flows through pipe 172 and into the flow control system 110. As the production stream flows through the flow control system 110, it may be routed through the flow control device where the flow rate of the production stream may be controlled by a flow control device. The production stream may then be transferred into transfer line 120. One skilled in the art will appreciate that the flow control system 110 may further include a production sub-sea tree. The production sub-sea tree is typically a system of valves, spools, fittings, and other pieces of equipment known in the art. Furthermore, the production sub-sea tree may be used to both prevent the release of the production stream from the wellbore into the environment and to direct and control the flow of the production stream exiting the wellbore.

Transfer line 120 is configured to transfer the production stream to manifold 130 or cold flow center 140. The transfer line 120 may be made of steel, alloy, or any other material known in the art that may withstand temperatures and pressures of the production stream. The transfer line 120 is coupled to both the manifold 130 and the flow control system 110. In some cases, the flow control system 110 is located at the manifold 130. The transfer line 120 may be coupled to the manifold 130 and the flow control system through the use of threads, bolts, or any other attachment method known in the art.

Each manifold 130 includes an assembly of valves that may be used to direct the flow of productions streams from multiple flow control systems 110 into at least one flow line 122 that connects the manifold 130 to the cold flow center 140. The manifold 130 is normally positioned near the wellbore. However, in certain embodiments, the manifold 130 may be positioned a selected distance from the wellbores 170. For example, there may be a situation when a large number of wellbores 170 are connected to the manifold 130 via transfer lines 120, and the wellbores 170 are spread over a substantial footprint having abnormal terrain and obstacles. Alternatively, transfer lines 120 may connect directly to the cold flow center 140.

The cold flow center 140 is configured to receive the flow of the production stream from one or more manifolds 130 via flow lines 122 and/or flow control systems 110 via transfer lines 120. As shown, each cold flow center 140 includes one or more cold flow devices 142. The flow lines 122 and transfer lines 120 are coupled to the cold flow device 142 of the cold flow center 140, through the use of threads, bolts, welding, or any other attachment method known in the art. During operation, the production stream flows from flow lines 122 or transfer lines 120 into cold flow device 142 of the cold flow center 140. The cold flow device 142 may receive production streams from each flow line 122 and transfer lines 120 simultaneously. One skilled in the art will appreciate that the ability to receive the production stream flow from the flow lines 122 and transfer lines 120 simultaneously may increase the efficiency of the transportation system 100.

The cold flow device 142 is configured to transform the production stream into transportable slurry that can be transported from the cold flow center 140 to the production system 160 (i.e., via tubular lines 180) without the need for temperature control. In one embodiment, the cold flow device 142 performs a number of steps: i) receives the warm production stream from flow lines 122 and transfer lines 120, ii) cools the production stream to near the surrounding ocean water temperature, iii) manages deposits in the cold flow device 142, and iv) forms a transportable slurry.

In another embodiment, the cold flow device 142 receives the warm production stream from flow lines 122 and transfer lines 120 and mixes already cooled production stream fluids and solids with the warm production streams. As the cool stream is mixed with the warm production stream, the cooled solids may assist in converting the production streams into a transportable slurry.

In another embodiment, the cold flow device 142 may further cool the production stream before or after the introduction of a cooler stream. This may be accomplished by directing the flow of the production stream through a heat exchanger. Further, the cold flow device 142 may include mixers, splitters, or chokes to enhance the efficiency of cooling and creating transportable slurry, while aiding the management of deposits on the wall of the tubular lines 180.

Referring now to FIG. 2, in an alternate embodiment, the transportation system 100 may include the cold flow center 240, similar to the cold flow center 140 shown FIG. 1. In this embodiment, however, the cold flow center 240 further includes the separator 244 that is configured to receive the production stream from the flow lines 122 and/or transfer lines 120. One skilled in the art will appreciate that the separator 244 may include a sub-sea separator, centrifugal separator, or any other separator known in the art. While the production stream flows through the separator 244, the separator 244 may separate some amount of fluids (e.g., water) and/or small particles (e.g., sand and solids) from the production stream. One skilled in the art will appreciate that by separating at least some amount of fluids and/or small particles from the production stream, the separator 244 may decrease the amount of hydrates that are formed while the production stream flows through the cold flow device 242. In addition, the separator 244 may also reduce the amount of processing needed by the production system or other devices used to process the production stream.

Once the separator 244 has processed the production stream, the production stream may be transferred to the cold flow device 242. Further, the fluids and/or small particles that were separated from the production stream by the separator 244 are transferred away from the separator 244. As shown, the separator 244 may include a first aperture 246, a second aperture 247, and valves 248, 249. The second aperture 247 is configured to allow the fluid and/or particles that are separated by the separator 244 to flow out of the separator 244 for disposal. The first aperture 246 is configured to allow the production stream that has been separated by the separator 244 to flow into the cold flow device 242. The valves 248, 249 are configured to control the flow of the fluids and/or small particles and the production stream exiting the separator 244. As such, if the valve 248 is open, the separated fluids and/or small particles may flow out of the second aperture 247 of the separator 244 for disposal (e.g., to a water treatment facility or into a disposal well). Further, if the valve 249 is open, the processed production stream may flow out of the first aperture 246 of the separator 244 and into the cold flow device 242.

Referring now to FIG. 3, in one embodiment, the cold flow center 240 may further include a pump 250 that has an inlet 252 and an outlet 254. During operation, the pump 250 receives the separated fluids and/or particles from the second aperture 247 of the separator 244 through inlet 252. Once the fluid and/or small particles have entered the pump 250 through inlet 252, the pump 250 may be used to pump the fluids and/or small particles through outlet 254 and through a fluid line 255. The fluid line 255 is coupled to the outlet 254 and may be used to transport the fluids and/or small particles from the pump 250 to a wellbore (not shown). The fluid and/or small particles transported to the wellbore may be injected into the wellbore for disposal. Those skilled in the art will appreciate that the pump 250 may include a centrifugal pump, gear pump, piston pump, or any other pumping device known in the art.

Referring back to FIG. 1, the cold flow centers 140 may positioned near the wellbores 170, because the production stream may only be capable of traveling a certain distance through the transfer lines 120 and/or flow lines 122 before it cools to a temperature at which deposits may form in transfer lines 122, 120. If the formation of these deposits is not controlled, the flow lines 120, 122 may be blocked.

In select embodiments the distance (between the wellbores 170 and cold flow center 140) may be substantial and could cause the production stream to form hydrates before it arrives at the cold flow center 140. This may be the result of having abnormal terrain and obstacles to consider. Thus, to control the temperature of the production stream, the flow lines 122 and transfer lines 120 may include a temperature controlling device 125, as shown in FIG. 4.

Figure 4:
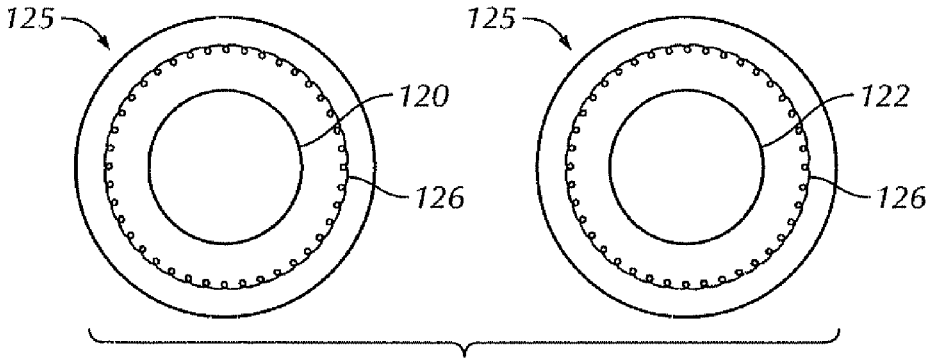
FIG. 4 shows a cross-sectional view of a transfer line and a flow line in accordance with embodiments of the present disclosure.

Referring now to FIG. 4, in one embodiment, the temperature controlling device 125 is disposed around the outer surface of the flow lines and transfer lines 122, 120. Further, the temperature controlling device 125 may include a mechanism 126 that surrounds the lines 120 and 122 and is used to retain and/or add heat to lines 120 and 122, thereby controlling the temperature of the production stream that flows through the lines 120 and 122. One skilled in the art will appreciate that the mechanism 126 may include insulation, insulating foam, a pipe in pipe arrangement, a conductive wire, electrical heaters, a heated pipe, heated fluid, or any other insulating and/or heating elements or devices known in the art. Furthermore, the temperature controlling device 125 may include a Heat Retention (HR) or Heat Retention and Heat Addition (HRHA) device. The Heat Retention device may include an insulating material embedded within the walls of the lines 120, 122 or wrapped around the exterior surface of the lines 120, 122 that may assist in controlling the temperature of the production stream flowing through the lines 120, 122. The Heat Retention and Heat Addition device may include an insulating material and a conductive material that may also be embedded within the walls of the lines 120, 122 or wrapped around the exterior surface of the lines 120, 122. Further, the conductive material may receive heat or power from an outside source to maintain the temperature of the production stream flowing through the lines 120, 122.

In one embodiment, the temperature controlling device 125 may be disposed along the full length of the flow and transfer lines 122, 120. Thus, the temperature controlling device 125 may control the temperature of the production stream at any location along the length of the flow and transfer lines 122, 120, while flowing through the flow and transfer lines 122, 120. In alternate embodiments, the temperature controlling device 125 may be disposed along select portions of the flow and/or transfer lines 122, 120.

Referring back to FIG. 1, tubular lines 180 are coupled to the cold flow centers 140 and are configured to transfer the production stream from the cold flow centers 140 to a production system 160. In this embodiment, the distant end 182 of the tubular lines 180 are coupled together through a connection 184 that directs the flow of the production stream from two or more tubular lines 180 into a single tubular line 180*a* that extends from the connection 184 to the production system 160. This may enable the production system 160 to only require one connection to receive the production stream from the single tubular line 180*a*. In an alternate embodiment, each tubular line 180 may extend from the cold flow center 140 to the production system 160, without combining the flow of fluids from multiple cold flow centers 140.

The production system 160 is configured to receive the production stream flowing through the tubular line 180 and/or 180*a*. The production system 160 may then store the production stream in a storage vessel (not show) that may eventually be removed and/or further processed. In one embodiment the production system 160 may include an offshore facility. In another embodiment, the production system 160 may include a onshore, land-based facility.

Embodiments of the present disclosure may include one or more of the following advantages. A transportation system that efficiently transfers production streams from multiple wellbores to a production system (e.g., land rig, off-shore rig). An apparatus that transforms the production stream into transportable slurry that may be transported from the cold flow center to the production system without the need for temperature control. A transportation system that may be used in various sub-sea terrains. A transportation system that controls the formation of hydrates and wax, thereby reducing or preventing the hydrates and wax from blocking the lines (e.g., transfer lines, flow lines, tubular lines) used to transfer the production stream.

The present disclosure provides the advantage of using fewer cold flow devices 142 to handle the production from all the wells required to extract the hydrocarbons in a field. The present disclosure enables efficient extraction of hydrocarbons from a field with multiple wells by i) gathering the well production streams via non-cold-flow technology to Cold Flow Centers, ii) processing the production streams, which may include water separation and disposal, at each Cold Flow Center to provide transportable slurry, and iii) transporting the slurry a topside facility.

An alternative, novel way to produce subsea fields is with one or more strings of cold flow centers. Where a string of cold flow centers:

1. Has two or more cold flow centers.
2. Each cold flow center receives an input stream from one or more well(s).
3. Each cold flow center transforms its input stream into a slurry stream suitable for transport without heat retention.
4. The cold flow processed streams from the two or more cold flow centers is transported to a topsides facility via a single flowline-system. (This could be a single flowline or multiple flowlines.)

An alternative, novel way to produce subsea fields is with a HR or HRAHA strategy for the flowlines to a cold flow center, and then cold flow transport from the cold flow center to topsides. This allows each cold flow center to service a larger aerial extent.

Illustrative Embodiments:

In one embodiment, there is disclosed a subsea production system, comprising a plurality of wells located on a sea floor, the wells producing a fluid comprising hydrocarbons; a cold flow center on the sea floor, the cold flow center fluidly connected to the plurality of wells; and a production facility on land or on a floating structure, the production facility fluidly connected to the cold flow center; wherein the cold flow center lowers a temperature of the fluid and produces a slurry of the fluid and suspended solids for transportation to the production facility. In some embodiments, the cold flow center comprises a separator adapted to remove water from the fluid before producing the transportable slurry. In some embodiments, the system also includes a plurality of cold flow centers fluidly connected to the production facility. In some embodiments, the system also includes a manifold fluidly connected between the cold flow center and at least two of the wells. In some embodiments, the cold flow center is at least 1 kilometer from one of the wells. In some embodiments, the cold flow center is at least 2 kilometers from one of the wells. In some embodiments, the cold flow center is at least 5 kilometers from the production facility. In some embodiments, the cold flow center is at least 10 kilometers from the production facility. In some embodiments, the cold flow center is at least 20 kilometers from the production facility. In some embodiments, the cold flow center is at least 50 kilometers from the production facility. In some embodiments, the cold flow center is at least 100 kilometers from the production facility. In some embodiments, the suspended solids comprise at least one of waxes, paraffins, hydrates, and asphaltenes. In some embodiments, the fluid comprises crude oil. In some embodiments, the fluid in the wells has a temperature from 30 to 100 degrees centigrade. In some embodiments, seawater adjacent to the cold flow center has a temperature from −10 to 10 degrees centigrade. In some embodiments, the system also includes the cold flow center lowers the temperature of the fluid from 10 to 80 degrees centigrade. In some embodiments, the cold flow center lowers the temperature of the fluid from 20 to 50 degrees centigrade.

In one embodiment, there is disclosed a method of producing hydrocarbons from a subsea field, comprising drilling a plurality of wells into the field on a seafloor; fluidly connecting the wells to a cold flow center; fluidly connecting the cold flow center to a production facility on land or on a floating offshore structure; producing a fluid comprising hydrocarbons from the wells to the cold flow center; lowering a temperature of the fluid at the cold flow center to precipitate out one or more solids into the fluid; forming a slurry of the fluid and the solids; and transporting the slurry from the cold flow center to the production facility. In some embodiments, the method also includes connecting at least two of the wells to a manifold, and then connecting the manifold to the cold flow center. In some embodiments, the method also includes separating water and/or solids from the fluid at the cold flow center. In some embodiments, the method also includes injecting the water into a disposal well.

Those of skill in the art will appreciate that many modifications and variations are possible in terms of the disclosed embodiments of the invention, configurations, materials and methods without departing from their spirit and scope. Accordingly, the scope of the claims appended hereafter and their functional equivalents should not be limited by particular embodiments described and illustrated herein, as these are merely exemplary in nature.

What is claimed is:

1. A subsea production system, comprising:

a plurality of wells located on a sea floor, the wells producing a fluid comprising hydrocarbons;

a cold flow center on the sea floor, the cold flow center fluidly connected to the plurality of wells; and a production facility on land or on a floating structure, the production facility fluidly connected to the cold flow center;

wherein the cold flow center lowers a temperature of the fluid and produces a slurry of the fluid and suspended solids for transportation to the production facility and wherein the cold flow center comprises a separator adapted to remove water and sand from the fluid before producing the transportable slurry.

2. The system of claim 1, further comprising a plurality of cold flow centers fluidly connected to the production facility.

3. The system of claim 1, further comprising a manifold fluidly connected between the cold flow center and at least two of the wells.

4. The system of claim 1, wherein the cold flow center is at least 1 kilometer from one of the wells.

5. The system of claim 1, wherein the cold flow center is at least 2 kilometers from one of the wells.

6. The system of claim 1, wherein the cold flow center is at least 5 kilometers from the production facility.

7. The system of claim 1, wherein the cold flow center is at least 10 kilometers from the production facility.

8. The system of claim 1, wherein the cold flow center is at least 20 kilometers from the production facility.

9. The system of claim 1, wherein the cold flow center is at least 50 kilometers from the production facility.

10. The system of claim 1, wherein the cold flow center is at least 100 kilometers from the production facility.

11. The system of claim 1, wherein the suspended solids comprise at least one of waxes, paraffins, hydrates, and asphaltenes.

12. The system of claim 1, wherein the fluid comprises crude oil.

13. The system of claim 1, wherein the fluid in the wells has a temperature from 30 to 100 degrees centigrade.

14. The system of claim 1, wherein seawater adjacent to the cold flow center has a temperature from −10 to 10 degrees centigrade.

15. The system of claim 1, wherein the cold flow center lowers the temperature of the fluid from 10 to 80 degrees centigrade.

16. The system of claim 1, wherein the cold flow center lowers the temperature of the fluid from 20 to 50 degrees centigrade.

17. A method of producing hydrocarbons from a subsea field, comprising:

drilling a plurality of wells into the field on a seafloor;

fluidly connecting the wells to a cold flow center;

fluidly connecting the cold flow center to a production facility on land or on a floating offshore structure;

producing a fluid comprising hydrocarbons from the wells to the cold flow center;

separating water and sand from the fluid at the cold flow center;

lowering a temperature of the fluid at the cold flow center to precipitate out one or more solids into the fluid;

forming a slurry of the fluid and the solids; and transporting the slurry from the cold flow center to the production facility.

18. The method of claim 17, further comprising: connecting at least two of the wells to a manifold, and then connecting the manifold to the cold flow center.

19. The method of claim 17, further comprising injecting the water into a disposal well.

* * * * *